US005430934A

United States Patent [19]

Groh et al.

[11] Patent Number: 5,430,934

[45] Date of Patent: Jul. 11, 1995

[54] METHOD FOR MANUFACTURING A DIRECT ACTING HYDRAULIC TAPPET

[75] Inventors: David M. Groh; Chris P. Kaniut; Steven L. Worthington; Martin W. Uitvlugt, all of Battle Creek; Scott C. Johnson, Marshall, all of Mich.

[73] Assignee: Eaton Corporation, Cleveland, Ohio

[21] Appl. No.: 139,481

[22] Filed: Oct. 20, 1993

Related U.S. Application Data

[62] Division of Ser. No. 950,534, Sep. 23, 1992, Pat. No. 5,280,771.

[51] Int. Cl.[6] ..... B23P 15/00

[52] U.S. Cl. ..... 29/888.43; 29/888.46; 123/90.52

[58] Field of Search ..... 123/90.48, 90.51, 90.55; 74/569; 29/888.43, 888.46, 888.4

[56] References Cited

U.S. PATENT DOCUMENTS

| | | | |
|---|---|---|---|
| 4,465,038 | 8/1984 | Speil | 123/90.55 |
| 4,590,898 | 5/1986 | Buente et al. | 123/90.55 |
| 4,602,409 | 7/1986 | Schaeffer | 29/888.43 |
| 4,876,997 | 10/1989 | Zorn et al. | 123/90.52 |
| 4,993,150 | 2/1991 | Reinhardt | 29/888.43 |

FOREIGN PATENT DOCUMENTS

| | | |
|---|---|---|
| 0335121 | 10/1989 | European Pat. Off. . |
| 3409236 | 9/1985 | Germany . |
| 3434492 | 3/1986 | Germany . |
| 61-055306 | 3/1986 | Japan . |
| 61-175204 | 8/1986 | Japan . |
| 2014072 | 8/1979 | United Kingdom . |

OTHER PUBLICATIONS

MTZ—Motortechnische Zeitschrift vol. 49 No. 3 Mar. 1988.

Welding and Metal Fabrication vol. 42, No. 4 Apr. 1974.

*Primary Examiner*—Irene Cuda

*Attorney, Agent, or Firm*—Frank M. Sajovec

[57] ABSTRACT

A method for making a direct acting tappet in which an oil groove and interior structure defining a weld interface are formed in a cupshaped body by a rolling process, the body is heat treated, a web and hub structure is positioned against the weld interface and the resulting assembly is subjected to a localized, capacitive discharge welding process in the weld interface area. The weld interface is formed to a specific shape to enhance the integrity of the weld. Further, a baffle member can be assembled to the web and hub structure prior to its positioning within the body member.

7 Claims, 2 Drawing Sheets

METHOD FOR MANUFACTURING A DIRECT ACTING HYDRAULIC TAPPET

This is a divisional of application Ser. No. 07/950,534 filed on Sep. 23, 1992, now U.S. Pat. No. 5,280,771.

The present invention relates generally to direct acting hydraulic tappets and specifically to a method for manufacturing such tappets.

In the manufacture of direct acting hydraulic tappets, customarily referred to as "bucket tappets," the structure shown in U.S. Pat. No. 4,590,898 to Buente et al, which is assigned to the assignee of this invention and incorporated herein by reference, has become universally accepted as a preferred structure, particularly in the way in which the hydraulic element is supported with respect to the tappet body. In this structure, the hydraulic element is supported by a web and hub structure wherein a web extends inward from the tubular body and wherein a hub formed integrally with the web supports the hydraulic element.

Since the adoption of the above design, efforts have been made to improve the structure in terms of reduced weight, enhanced manufacturability, and material improvements. One such effort is shown in U.S. Pat. No. 4,602,409 to Schaeffler which discloses a cup-shaped, one-piece body with a web and hub element which is welded in place. Other known designs include a one piece body element with the web and hub structure fixed thereto by swaging or by some other known metal deformation process.

In all of the above designs, an important requirement is that the joint between the body element and the web and hub element be sealed.

Welding is the most reliable means for forming this joint for structural rigidity considerations as well as for sealing; however, there are certain problems associated with the welding process and subsequent heat treating processes. Generally, heat treatments which include quenching of previously assembled parts can result in problems with distortion, higher scrap and re-work, cleaning and drag out of quenching fluids. As a result, additional operations may be required, thus increasing product cost.

Another factor to be considered is that in some applications it is beneficial to add an oil flow affecting element such as a baffle to the internal structure of the Another factor to be considered is that in some applications it is beneficial to add an oil flow affecting element such as a baffle to the internal structure of the tappet. This further complicates the ability to clean the assembly after heat treatment.

If the assembly is heat treated after welding, the cleaning process is even more difficult than if no baffle is used.

If the assembly is welded after heat treating using conventional welding techniques, it is necessary to use barriers or stopoff techniques prior to heat treatment in order to obtain a satisfactory weld joint. Such stopoff techniques prevent carbon and nitrogen from penetrating the surface of the part to permit conventional welding operations to be performed. These techniques, however, are time consuming, making their feasibility in high volume production questionable.

It is an object of the present invention to provide an improved body assembly for a direct acting hydraulic tappet of the type wherein a web and hub structure is welded to a one-piece, cup-shaped body element.

It is further an object to provide a method for manufacturing such a body assembly including optimizing the geometry of the elements in the area of the weld joint and optimizing the process associated with preparing the parts for welding and for optimizing the welding process per se.

Other objects and advantages of the invention will be apparent from the following description when considered in connection with the accompanying drawings, wherein.

Figure 1:
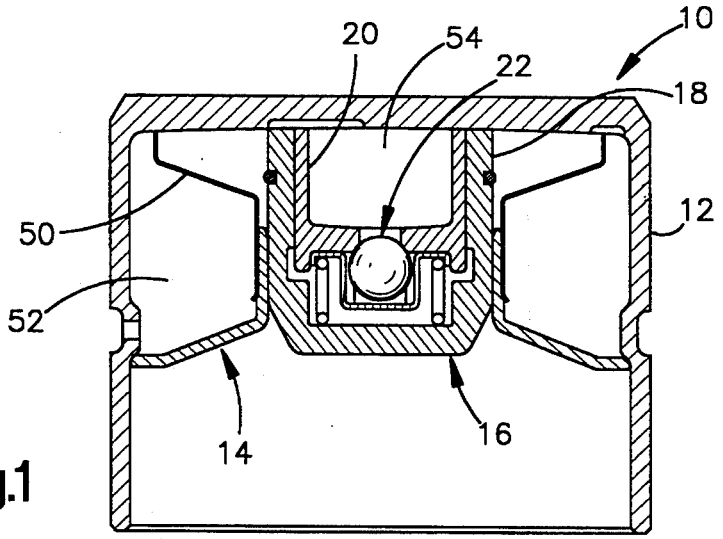
FIG. 1 is a cross-sectional view of a direct acting tappet constructed in accordance with the invention.

Referring to FIG. 1, there is illustrated a direct acting hydraulic tappet 10 comprising a cup-shaped body 12, a web and hub element 14, and a hydraulic assembly 16. The hydraulic assembly per se is not part of the present invention, and typically comprises a plunger 18 in sliding engagement with the hub portion of the web and hub element, a piston 20 in sliding engagement with the plunger, and a check valve assembly 22.

Figure 2A:
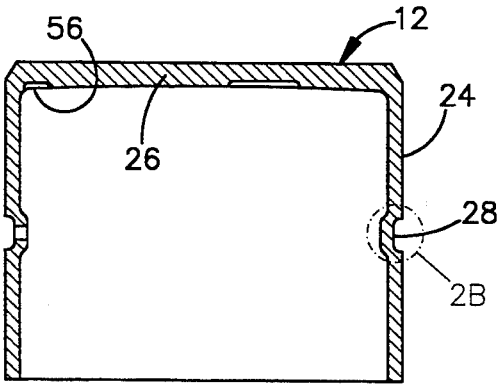
FIG. 2A is a sectional view of the tappet body.
Figure 2B:
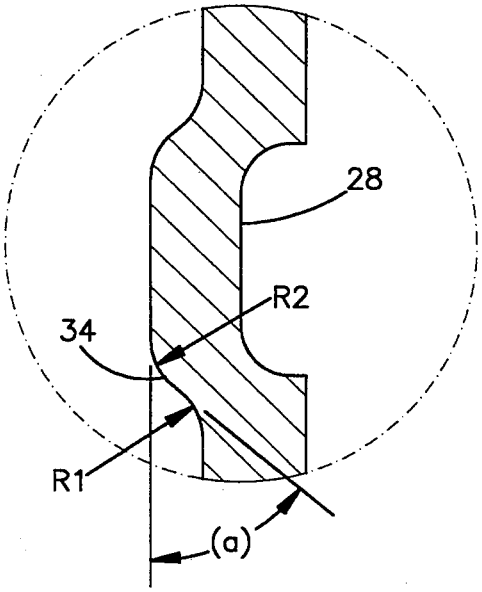
FIG. 2B is an enlargement of a portion of FIG. 2A.

Referring to FIGS. 2A and 2B, the body 12 is formed of a hardenable alloyed steel such as SAE-5120 by a forging process which produces a very lightweight body having a thin wall section 24 and a relatively thicker top or cam face portion 26. An oil groove 28 is formed by a rolling process as will be described in more detail below, which process also forms the interior of the body in a configuration which significantly enhances the weld joint between the web and hub assembly 14 and the body. Referring particularly to FIG. 2B, the surface designated 34 defines the interface between the web and hub 14 and the body, and it has been determined that an optimum weld joint can be obtained if the angle designated (a) of the interface is maintained at 44°±2° degrees, the radius designated R1 is 12.7 mm (0.5 in.)±6.35 mm (0.25 in.), and the radius designated R2 is 25.4 mm (1.0 in.)±6.35 mm (0.25 in.).

Figure 3:
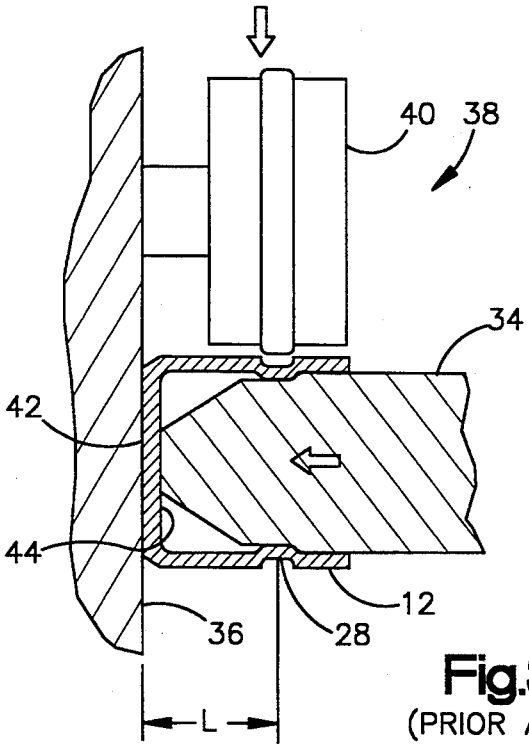
Fig.3 (PRIOR ART)
FIG. 3 is a schematic illustration of a prior art method for forming an oil groove in a tappet body.
Figure 4:
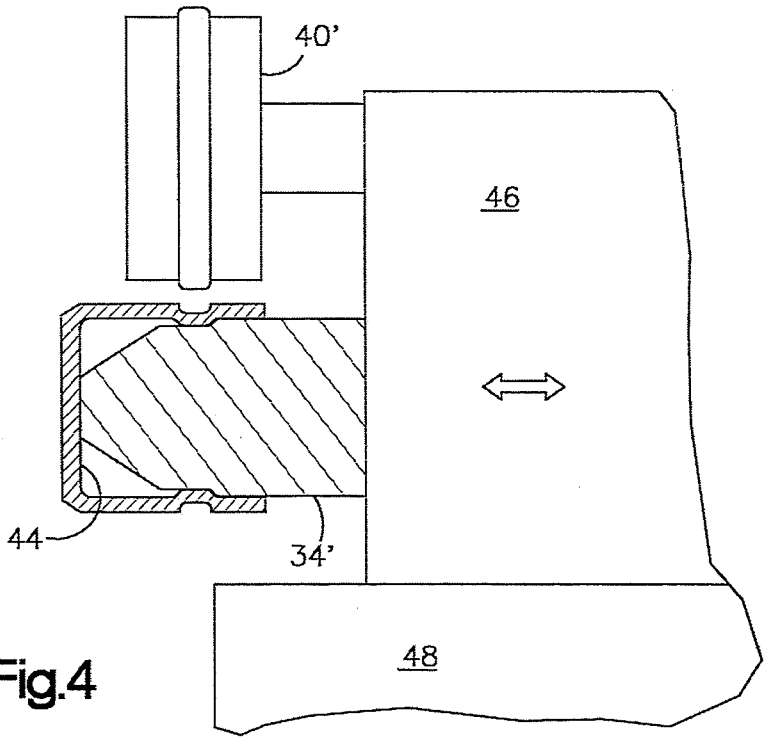
FIG. 4 is a schematic illustration of a method for forming an oil groove in a tappet body in accordance with the invention.

The above weld interface geometry is obtained using a novel rolling process illustrated schematically in FIG. 4, with a prior art process illustrated schematically in FIG. 3 for comparison.

FIG. 3 illustrates a prior art method for forming the oil groove 28 and the weld interface in the body 12. In this method, a mandrel 34 is inserted into the body, and the body is located independently of the mandrel with the outer surface 42 of the body located in relation to a reference line 36, after which a grooving tool 40 is forced into engagement with the body 12 while the body is rotated. Using this method the distance L between the cam face of the lifter body and the center of the oil groove is located off the outer surface of the cam face portion of the body while the inside contour, which is specifically adapted to define the weld interface described above, is determined by the shape of the mandrel, which locates off the inner surface of the cam face. Because there can be significant variation in the face thickness, this can produce inconsistencies in the groove and weld interface locations.

In the improved method illustrated in FIG. 4, the groove and weld interface characteristics are both located off the inner surface of the cam face. This is accomplished by means of rolling equipment 38' in which the mandrel 34' and the grooving tool 40' are mounted on a single slide 46 which is linearly movable in the direction of the double arrow relative to a base member 48, and wherein the mandrel rotates about its longitudinal axis. Using this method, the oil groove defined by the shape of the grooving tool and the weld interface defined by the mandrel are both located off the inner surface 44 of the body and will thus be consistent regardless of variations in cam face thickness.

Figure 5:
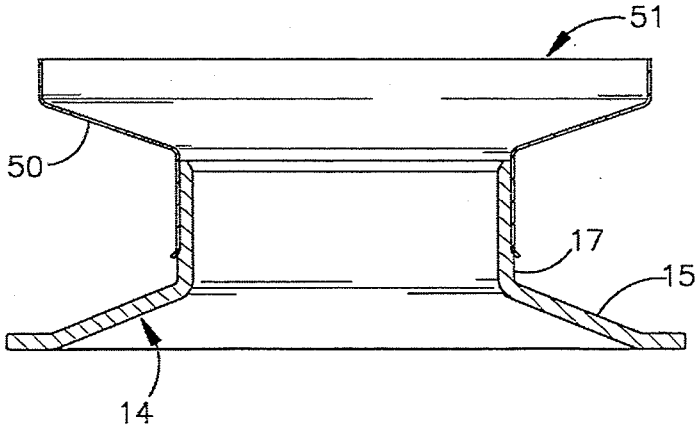
FIG. 5 is a sectional view of a web and hub assembly prior to assembly.

Referring to FIGS. 1 and 5, as referred to above, in certain applications of bucket tappets it is beneficial to include a baffle 50 in the secondary oil reservoir 52 of the tappet so that oil drainage is inhibited when the engine is not running. Prior art baffle designs which are generally welded or otherwise fixed rigidly in place, can be relatively heavy, and do not extend to the full height of the secondary reservoir.

In accordance with the present invention, the baffle 50 is very thin, preferably 0.25 mm±0.025 mm and is press fit onto the hub portion 17 of the web and hub element 14, to form an assembly designated 51. The baffle 50 is initially only partially pressed onto the assembly 51 such that the height of the partially assembled web and hub and baffle assembly is greater than the distance between the weld interface against which the web is located and the inner surface 44. When the web and hub and baffle assembly is positioned for welding, the process of fixturing the assembly for welding will cause the baffle 50 to be positioned against the surface 44 of the body regardless of variations in location, thicknesses and tolerance stackups.

In accordance with a further aspect of the invention, an oil flowpath over the top of the baffle is defined by forming a depression 56 in the surface 44, which depression can be formed during the body forging process and which is located so that it intersects the top surface of the baffle. The positioning of the baffle against the inner surface of the body and providing a flowpath above the baffle maximizes the volume of the secondary reservoir.

In accordance with the invention, the web and hub element 14 is preferably formed of a medium carbon steel such as SAE 1050 and the body only is heat treated prior to assembly. It is understood, however, that other heat treatable ferrous materials can be used. The heat treatment process per se is not part of the present invention; however, any well known surface hardening such as carbonitriding or carburizing can be used, As discussed above, heretofore it has not been considered to be desirable to weld after heat treatment without using time-consuming masking procedures, because the heat treat method can have adverse effects on the welding process. The capacitive discharge (CD) welding process is tolerant of many hardening processes while maintaining weld integrity and this is a preferred method for fixing the web and hub element to the body.

Once the assembly of the web and hub element to the body is completed, the assembly is placed in a suitable fixture and the area of the interface 34 of the web and hub with the body is subjected to a capacitive discharge (CD) welding process. The CD welding process is well known in the art and won't be discussed herein in detail; however, the use of this specific process in the present application is significant in several respects and thus warrants some discussion.

In the CD welding process, the welding energy is produced by a high speed, short duration electrical discharge of previously energized capacitors. The sudden discharge of energy liquifies the metal at the weld interface in a very localized area. The weld discharge time is typically less than 10 milliseconds; therefore, very little heating occurs outside the weld area. Also, because of the extremely short weld time and the localization of the weld which is made possible by the CD welding process, the heat treated areas outside the localized welding zone will not be adversely affected by the welding process. As described above, in the past it was not considered feasible to weld to members such as the body herein, which are high in carbon and nitrogen as the result of heat treating, because the welding process resulted in decomposition of the carbon and nitrogen. In using the present process, however, no such decomposition has been observed. When the weld process is completed, the assembly is tempered in accordance with accepted practices which are well known in the art.

Figure 6:
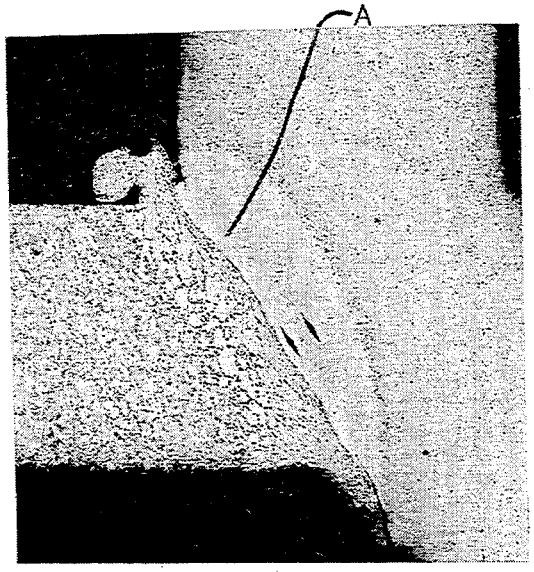
FIG. 6 is a photomicrograph of a weld produced in accordance with the invention.

Referring to FIG. 6, it can be observed that the heat affected zone, designated A, of the welded tappet assembly shows a fine, crystalline martensitic microstructure, which is necessary to obtain a high weld strength.

Upon completion of the body assembly, the hydraulic assembly is inserted into the web and hub assembly 14 to complete the hydraulic tappet assembly 10 as shown in FIG. 1.

We claim:

1. A method for manufacturing a direct acting hydraulic tappet comprising the steps of forming a generally cup-shaped body member; forming a circumferential groove in the outer wall of said body member, said groove-forming process deflecting the material interior of said body member to a predetermined shape; heat treating said body; locating a web and hub element against said predetermined shape, the periphery of the web portion of said web and hub element and said predetermined shape defining a weld interface; and welding said web and hub element to said body member by a localized welding process applied in the area of said interface, characterized by said groove being formed by mounting said body member on a rotating mandrel with the inner bottom face of said body member located against the end of the mandrel, said mandrel having a depression formed therein corresponding to said predetermined shape, and contacting the outer wall of said body member with a groove forming tool, the distance between the end of said mandrel and said depression and the distance between the end of said mandrel and said groove forming tool being determined from a common reference point.

2. A method for manufacturing a direct acting hydraulic tappet comprising the steps of forming a generally cup-shaped body member; forming a circumferential groove in the outer wall of said body member, said groove-forming process deflecting the material interior of said body member to a predetermined shape; heat treating said body; locating a web and hub element against said predetermined shape, the periphery of the web portion of said web and hub element and said predetermined shape defining a weld interface; and welding said web and hub element to said body member by means of capacitive discharge welding process applied in the area of said interface.

3. A method as claimed in either of claims 1 or 2 in which said predetermined shape comprises a surface formed in the inside wall of said body member which defines an angle between 42 degrees and 46 degrees to a line parallel to the longitudinal axis of said body member, said surface defining said weld interface.

4. A method as claimed in claim 3 in which said surface is bounded by a first radius between 6.35 mm (0.25 in.) and 19.05 mm (0.75 in.) convex to the interior of said body member and a second radius between 19.05 mm (0.75 in.) and 1.75 mm (1.25 in.) concave to the interior of said body member.

5. A method as claimed in either of claims 1 or 2, in which said body is formed of a hardenable alloyed steel.

6. A method as claimed in claim 5, in which said web and hub element is formed of a medium carbon steel.

7. A method as claimed in either of claims 1 or 2, including the steps of press fitting a thin-walled baffle member onto the hub portion of said web and hub element to a predetermined position along the longitudinal axis of said hub portion prior to locating said web and hub element against said predetermined shape, said baffle member being repositioned on said hub portion by said locating step to located an end of said baffle member against the inner bottom face of said body member.

* * * * *